US007879518B2

(12) United States Patent
Coggan et al.

(10) Patent No.: US 7,879,518 B2
(45) Date of Patent: Feb. 1, 2011

(54) PHOTORECEPTOR

(75) Inventors: Jennifer A. Coggan, Cambridge (CA); Gregory McGuire, Mississauga (CA); Nan-Xing Hu, Oakville (CA); Ah-Mee Hor, Mississauga (CA)

(73) Assignee: Xerox Corporation, Norwalk, CT (US)

( * ) Notice: Subject to any disclaimer, the term of this patent is extended or adjusted under 35 U.S.C. 154(b) by 226 days.

(21) Appl. No.: 11/942,932

(22) Filed: Nov. 20, 2007

(65) Prior Publication Data

US 2009/0130575 A1 May 21, 2009

(51) Int. Cl.
*G03G 5/047* (2006.01)

(52) U.S. Cl. ..... 430/58.8; 430/59.1; 430/59.4; 430/66

(58) Field of Classification Search ..... 430/58.8, 430/59.1, 59.4, 66
See application file for complete search history.

(56) References Cited

U.S. PATENT DOCUMENTS

| | | | | |
|---|---|---|---|---|
| 3,121,006 | A | 2/1964 | Middleton et al. | |
| 4,265,990 | A | 5/1981 | Stolka et al. | |
| 4,306,008 | A * | 12/1981 | Pai et al. | 430/58.8 |
| 4,464,450 | A | 8/1984 | Teuscher | |
| 4,555,463 | A | 11/1985 | Hor et al. | |
| 4,587,189 | A | 5/1986 | Hor et al. | |
| 4,921,773 | A | 5/1990 | Melnyk et al. | |
| 4,931,372 | A * | 6/1990 | Takei et al. | 430/66 |
| 4,943,501 | A * | 7/1990 | Kinoshita et al. | 430/58.5 |
| 5,482,811 | A | 1/1996 | Keoshkerian et al. | |
| 5,521,306 | A | 5/1996 | Burt et al. | |
| 6,139,999 | A * | 10/2000 | Fuller et al. | 430/58.65 |
| 6,156,468 | A | 12/2000 | Wehelie et al. | |
| 6,177,219 | B1 | 1/2001 | Yuh et al. | |
| 6,255,027 | B1 | 7/2001 | Wehelie et al. | |
| 6,913,863 | B2 | 7/2005 | Wu et al. | |
| 2005/0053854 | A1 * | 3/2005 | Pai et al. | 430/58.65 |
| 2007/0026333 | A1 * | 2/2007 | Wu et al. | 430/66 |

FOREIGN PATENT DOCUMENTS

JP 2003-186231 * 7/2003

OTHER PUBLICATIONS

English translation of JP 2003-186231 published Jul. 2003.*
"Handbook of Imaging Materials," Diamond, Marcel Dekker, NY, NY, 1991. p. 160-162.*

* cited by examiner

*Primary Examiner*—Mark F Huff
*Assistant Examiner*—Peter L Vajda
(74) *Attorney, Agent, or Firm*—Oliff & Berridge, PLC

(57) ABSTRACT

Disclosed is a photoreceptor including a substrate, a charge generating layer, and a charge transport layer having a tertiary aryl amine charge transport molecule represented by the following general formula in which $Ar^1$, $Ar^2$, $Ar^3$, $Ar^4$ and $Ar^5$ each independently represents a substituted or unsubstituted aryl group, or $Ar^5$ independently represents a substituted or unsubstituted arylene group, and k represents 0 or 1, and in which at least two of $Ar^1$, $Ar^2$, $Ar^3$ and $Ar^4$ includes a hydroxymethyl group or an alkoxymethyl group having from 1 to about 6 carbon atoms, having an oxidation potential of from about 0.75 V to about 1.0 V as measured vs. Ag/AgCl in 0.1 M tetra-n-butylammonium perchlorate in dichloromethane, and an antioxidant capable of reacting with the charge transport molecule. Disclose is also a process for forming the photoreceptors described herein and a method of forming an image with the photoreceptors described herein.

11 Claims, 3 Drawing Sheets

PHOTORECEPTOR

TECHNICAL FIELD

This disclosure is generally directed to electrophotographic imaging members and, more specifically, to layered photoreceptor structures comprising a charge transport layer comprising hole transport molecule represented by the following general formula

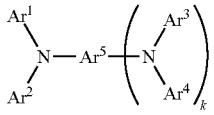

and an antioxidant.

REFERENCES

There is illustrated in U.S. patent application Ser. No. 11/756,077 to Aziz, et al., filed concurrently herewith, the entire disclosure of which is totally incorporated herein by reference, a photoreceptor comprising a substrate, a charge generating layer, a charge transport layer comprising N,N,N'N'-tetra(4-methylphenyl)-(1,1'-biphenyl)-4,4'-diamine having a purity of from about 95 percent to about 100 percent; and a protective overcoating layer optionally comprising a hole transport material other than N,N,N'N'-tetra(4-methylphenyl)-(1,1'-biphenyl)-4,4'-diamine; wherein the photoreceptor will discharge from about 85% to about 100% of its surface potential in from 0 to about 40 milliseconds upon being subjected to xerographic charging and exposure to radiant energy of from about 1 erg/cm$^2$ to about 5 ergs/cm$^2$.

Layered photoresponsive imaging members have been described in numerous U.S. patents, such as U.S. Pat. No. 4,265,990, wherein there is illustrated an imaging member comprised of a photogenerating layer, and an aryl amine hole transport layer. Examples of photogenerating layer components include trigonal selenium, metal phthalocyanines, vanadyl phthalocyanines, and metal free phthalocyanines. Additionally, there is described in U.S. Pat. No. 3,121,006, the disclosure of which is totally incorporated herein by reference, a composite xerographic photoconductive member comprised of finely divided particles of a photoconductive inorganic compound and an amine hole transport dispersed in an electrically insulating organic resin binder.

There is illustrated in U.S. Pat. No. 6,913,863, a photoconductive imaging member comprised of a hole blocking layer, a photogenerating layer, and a charge transport layer, and wherein the hole blocking layer is comprised of a metal oxide; and a mixture of a phenolic compound and a phenolic resin wherein the phenolic compound contains at least two phenolic groups.

In U.S. Pat. No. 4,555,463, is illustrated a layered imaging member with a chloroindium phthalocyanine photogenerating layer.

In U.S. Pat. No. 4,587,189, there is illustrated a layered imaging member with, for example, a perylene, pigment photogenerating component. Both of the aforementioned patents disclose an aryl amine component, such as N,N'-diphenyl-N,N'-bis(3-methylphenyl)-1,1'-biphenyl-4,4'-diamine dispersed in a polycarbonate binder as a hole transport layer. The above components, such as the photogenerating compounds and the aryl amine hole transport molecules, can be selected for the imaging members of the present disclosure in embodiments thereof.

Illustrated in U.S. Pat. Nos. 6,255,027; 6,177,219, and 6,156,468, are, for example, photoreceptors containing a hole blocking layer of a plurality of light scattering particles dispersed in a binder, reference for example, Example I of U.S. Pat. No. 6,156,468, the disclosure of which is totally incorporated herein by reference, wherein there is illustrated a hole blocking layer of titanium dioxide dispersed in a specific linear phenolic binder of VARCUM™, available from OxyChem Company.

Illustrated in U.S. Pat. No. 5,521,306, is a process for the preparation of Type V hydroxygallium phthalocyanine photogenerating pigments comprising the in situ formation of an alkoxy-bridged gallium phthalocyanine dimer, hydrolyzing the dimer to hydroxygallium phthalocyanine, and subsequently converting the hydroxygallium phthalocyanine product to Type V hydroxygallium phthalocyanine.

Illustrated in U.S. Pat. No. 5,482,811, is a process for the preparation of hydroxygallium phthalocyanine photogenerating pigments which comprises hydrolyzing a gallium phthalocyanine precursor pigment by dissolving the hydroxygallium phthalocyanine in a strong acid and then reprecipitating the resulting dissolved pigment in basic aqueous media; removing any ionic species formed by washing with water, concentrating the resulting aqueous slurry comprised of water and hydroxygallium phthalocyanine to a wet cake; removing water from said slurry by azeotropic distillation with an organic solvent, and subjecting said resulting pigment slurry to mixing with the addition of a second solvent to cause the formation of said hydroxygallium phthalocyanine polymorphs.

There is disclosed in U.S. Pat. No. 4,306,008, imaging or photosensitive members with at least two electrically operative layers of a photoconductive layer and a charge transport layer containing a polycarbonate resin and from about 25 to about 75 percent by weight of a substituted aryl diamine, of the formula recited in the abstract and column 6.

The disclosures of each of the foregoing patents are hereby incorporated by reference herein in their entireties. The appropriate components and process aspects of the each of the foregoing patents may also be selected for the present compositions and processes in embodiments thereof.

BACKGROUND

In electrophotography, also known as Xerography, electrophotographic imaging or electrostatographic imaging, the surface of an electrophotographic plate, drum, belt or the like (imaging member or photoreceptor) containing a photoconductive insulating layer on a conductive layer is first uniformly electrostatically charged. The imaging member is then exposed to a pattern of activating electromagnetic radiation, such as light. The radiation selectively dissipates the charge on the illuminated areas of the photoconductive insulating layer while leaving behind an electrostatic latent image on the non-illuminated areas. This electrostatic latent image may then be developed to form a visible image by depositing finely divided electroscopic marking particles on the surface of the photoconductive insulating layer. The resulting visible image may then be transferred from the imaging member directly or indirectly (such as by a transfer or other member) to a print substrate, such as transparency or paper. The imaging process may be repeated many times with reusable imaging members.

Although excellent toner images may be obtained with multilayered belt or drum photoreceptors, it has been found that as more advanced, higher speed electrophotographic copiers, duplicators, and printers are developed, there is a greater demand on print quality. The delicate balance in charging image and bias potentials, and characteristics of the toner and/or developer, must be maintained. This places additional constraints on the quality of photoreceptor manufacturing, and thus on the manufacturing yield.

Imaging members are generally exposed to repetitive electrophotographic cycling, which subjects the exposed charged transport layer or alternative top layer thereof to mechanical abrasion, chemical attack and heat. This repetitive cycling leads to gradual deterioration in the mechanical and electrical characteristics of the exposed charge transport layer. Physical and mechanical damage during prolonged use, especially the formation of surface scratch defects, is among the chief reasons for the failure of belt photoreceptors. Therefore, it is desirable to improve the mechanical robustness of photoreceptors, and particularly, to increase their scratch resistance, thereby prolonging their service life.

Known in the art are photoreceptors with a hole transport material, such as a substituted biphenyl diamine, that may result in low post erase voltages; excellent electrical cycling stability; excellent wear resistance; extended photoreceptor lifetime; and provide for the elimination or minimization of imaging member scratches on the surface layer or layers of the imaging member. Additionally, such imaging members may possess an excellent rate of discharge, and in a number of instances low $V_r$ (residual potential), and allow the substantial prevention of $V_r$ cycle up when appropriate; high sensitivity; low acceptable image ghosting characteristics; and desirable toner cleanability.

However, the conventional charge transport formulation with only a charge transport material such as a substituted biphenyl diamine may exhibit an unacceptably high level of deletion due to lateral charge migration in the charge transport layer.

Despite the various approaches that have been taken for forming imaging members there remains a need for improved imaging member design to provide reduced lateral charge migration in the charge transport layer while maintaining high hole mobility.

SUMMARY

This disclosure addresses some or all of the above described problems and also provides materials and methods for reduced lateral charge migration in the charge transport layer. This disclosure is directed to a charge transport layer comprising antioxidants that are selected so as to match the oxidation potential of the hole transport material. The antioxidants may be chosen, for example, from among sterically hindered bis-phenols, sterically hindered dihydroquinones, or sterically hindered amines. This disclosure also relates to processes for making and using the imaging members.

The photoreceptors disclosed herein have many advantages and improvements, such as reduced lateral charge migration (LCM) or deletion on long term cycling, extended lifetimes of service of, for example, in excess of about 500,000 imaging cycles; excellent electronic characteristics; excellent rate of discharge; stable electrical properties; low image ghosting; resistance to charge transport layer cracking upon exposure to the vapor of certain solvents; excellent surface characteristics; improved wear resistance; compatibility with a number of toner compositions; the avoidance of or minimal imaging member scratching characteristics; consistent $V_r$ (residual potential) that is substantially flat or no change over a number of imaging cycles as illustrated by the generation of known PIDC (Photo-Induced Discharge Curve), and the like.

In an embodiment, the present disclosure provides an electrophotographic imaging member comprising a substrate, a charge generating layer;

a charge transport layer comprising a tertiary arylamine charge transport molecule represented by the following general formula

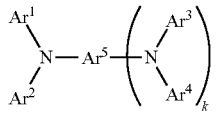

wherein $Ar^1$, $Ar^2$, $Ar^3$, and $Ar^4$ each independently represents a substituted or unsubstituted aryl group having from about 6 to about 30 carbons, $Ar^5$ independently represents a substituted or unsubstituted aromatic group from about 6 to about 30 carbons, and k represents 0 or 1, wherein said tertiary arylamine may have an oxidation potential of from about 0.75 V to about 1.0 V (as measured vs. Ag/AgCl in 0.1 M tetra-n-butylammonium perchlorate in dichloromethane), and an antioxidant.

In an embodiment, the electrophotographic imaging member described herein further comprises a protective layer in contact with the charge transport layer, wherein the protective layer is comprised of a cured coating composition comprising a tertiary arylamine having a hydroxyl group.

In another embodiment, the present disclosure provides a process for forming an electrophotographic imaging member comprising:

providing a photoreceptor substrate;

applying a charge generating layer;

applying a charge transport layer comprising a tertiary arylamine molecule represented by the following general formula

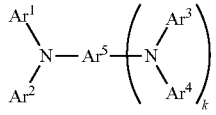

wherein $Ar^1$, $Ar^2$, $Ar^3$, and $Ar^4$ each independently represents a substituted or unsubstituted aryl group having from about 6 to about 30 carbons, $Ar^5$ independently represents a substituted or unsubstituted aromatic group from about 6 to about 30 carbons, and k represents 0 or 1, wherein said tertiary arylamine may have an oxidation potential of from about 0.75 V to about 1.0 V (as measured vs. Ag/AgCl in 0.1 M tetra-n-butylammonium perchlorate in dichloromethane), and an antioxidant; and optionally applying a protective overcoat layer over the substrate.

In another embodiment, the present disclosure also provides electrophotographic image development devices comprising such electrophotographic imaging members. Also provided are imaging processes using such electrophotographic imaging members.

Additionally disclosed are flexible imaging members and layered belt photoresponsive or photoconductive imaging members comprising a hole transport material and antioxidants selected to match the oxidation potential of the hole transport material and, for example, that are sterically hindered bis-phenols, sterically hindered dihydroquinones, or sterically hindered amines.

DETAILED DESCRIPTION

Figure 1:
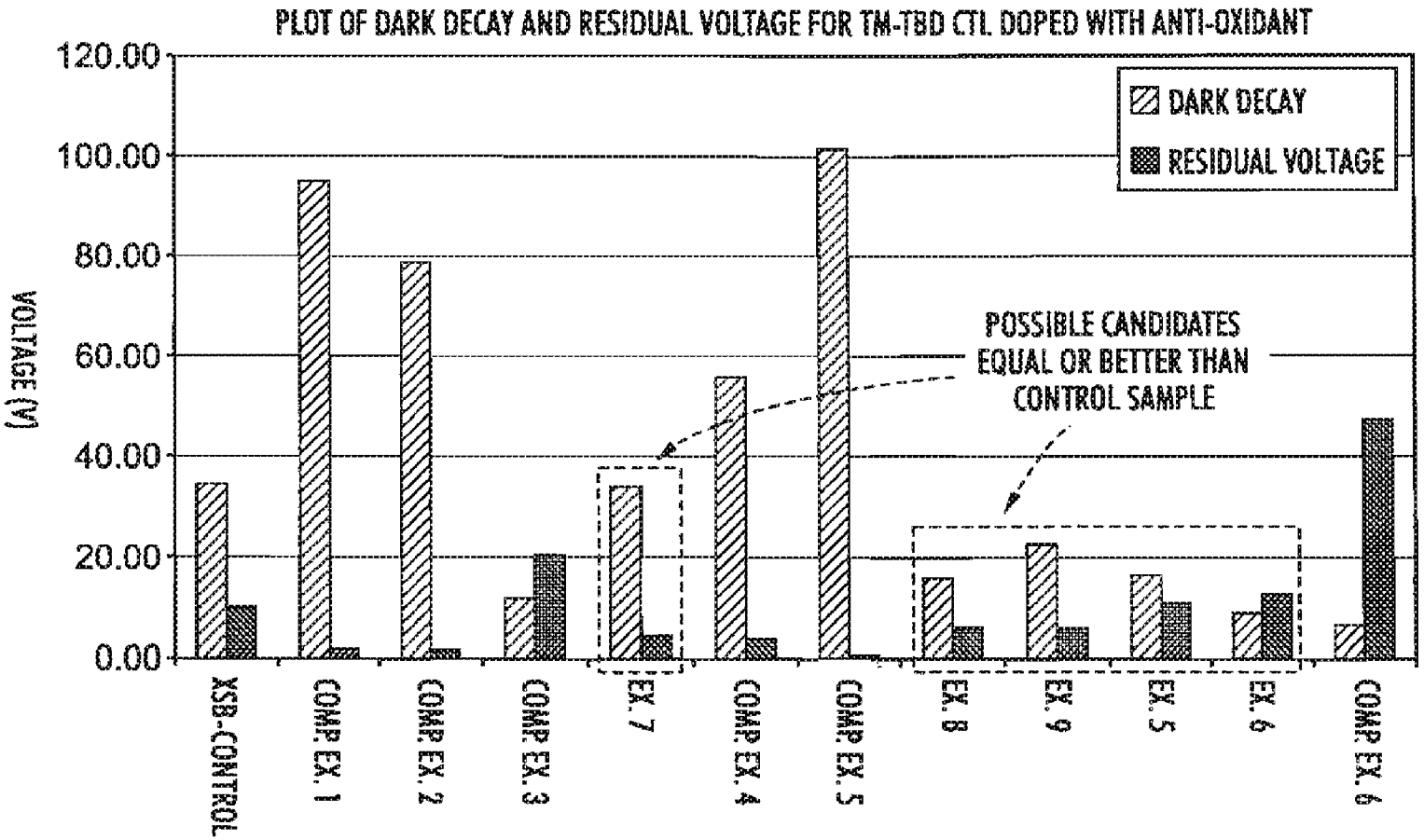
FIGS. 1 and 2 are graphs showing a plot of dark decay and residual voltage for photoreceptors of the Examples and Comparative Examples of the disclosure.

The present disclosure relates generally to photoconductive imaging members such as photoconductors, photoreceptors and the like, for example which may be used in electrophotographic or xerographic imaging processes. Aspects of the present disclosure relate to antioxidants for use in photoreceptors containing a hole transport component, such as a tertiary aryl amine.

The photoconductive imaging members are, in embodiments, multilayered photoreceptors that comprise a substrate, an optional conductive layer, an optional undercoat layer, an optional adhesive layer, a charge generating layer, a charge transport layer, and an optional protective overcoat layer. The charge transport layer further comprises at least one antioxidant selected so as to match the oxidation potential of the hole transport material. The antioxidants may be chosen, for example, from among sterically hindered bis-phenols, sterically hindered dihydroquinones, or sterically hindered amines. Exemplary sterically hindered bis-phenols may be, for example, 2,2'-methylenebis(4-ethyl-6-tert-butylphenol). Exemplary sterically hindered dihydroquinones can be, for example, 2,5-di(tert-amyl)hydroquinone or 4,4'-thiobis(6-tert-butyl-o-cresol and 2,5-di(tert-amyl)hydroquinone. Exemplary sterically hindered amines can be, for example, 4,4'-[4-diethylamino)phenyl]methylene]bis(N,N diethyl-3-methylaniline and bis(1,2,2,6,6-pentamethyl-4-piperidinyl)(3,5-di-tert-butyl-4-hydroxybenzyl)butylpropanedioate.

Electrophotographic imaging members are known in the art. Electrophotographic imaging members may be prepared by any suitable technique. Typically, a flexible or rigid substrate is provided with an electrically conductive surface. A charge generating layer is then applied to the electrically conductive surface. A charge blocking layer may optionally be applied to the electrically conductive surface prior to the application of a charge generating layer. If desired, an adhesive layer may be utilized between the charge blocking layer and the charge generating layer. Usually the charge generation layer is applied onto the blocking layer and a hole or charge transport layer is formed on the charge generation layer, followed by an optional overcoat layer. This structure may have the charge generation layer on top of or below the hole or charge transport layer. In embodiments, the charge generating layer and hole or charge transport layer can be combined into a single active layer that performs both charge generating and hole transport functions.

The substrate may be opaque or substantially transparent and may comprise any suitable material having the required mechanical properties. Accordingly, the substrate may comprise a layer of an electrically non-conductive or conductive material such as an inorganic or an organic composition. As electrically non-conducting materials there may be employed various resins known for this purpose including polyesters, polycarbonates, polyamides, polyurethanes, and the like which are flexible as thin webs. An electrically conducting substrate may be any metal, for example, aluminum, nickel, steel, copper, and the like or a polymeric material, as described above, filled with an electrically conducting substance, such as carbon, metallic powder, and the like or an organic electrically conducting material. The electrically insulating or conductive substrate may be in the form of an endless flexible belt, a web, a rigid cylinder, a sheet and the like. The thickness of the substrate layer depends on numerous factors, including strength desired and economical considerations. Thus, for a drum, this layer may be of substantial thickness of, for example, up to many centimeters or of a minimum thickness of less than a millimeter. Similarly, a flexible belt may be of substantial thickness, for example, about 250 micrometers, or of minimum thickness less than 50 micrometers, provided there are no adverse effects on the final electrophotographic device.

In embodiments where the substrate layer is not conductive, the surface thereof may be rendered electrically conductive by an electrically conductive coating. The conductive coating may van, in thickness over substantially wide ranges depending upon the optical transparency, degree of flexibility desired, and economic factors. Accordingly, for a flexible photoresponsive imaging device, the thickness of the conductive coating may be about 20 angstroms to about 750 angstroms, such as about 100 angstroms to about 200 angstroms for an optimum combination of electrical conductivity, flexibility and light transmission. The flexible conductive coating may be an electrically conductive metal layer formed, for example, on the substrate by any suitable coating technique, such as a vacuum depositing technique or electrodeposition. Typical metals include aluminum, zirconium, niobium, tantalum, vanadium and hafnium, titanium, nickel, stainless steel, chromium, tungsten, molybdenum, and the like.

Illustrative examples of substrates are as illustrated herein, and more specifically layers selected for the imaging members of the present disclosure, and which substrates can be opaque or substantially transparent comprise a layer of insulating material including inorganic or organic polymeric materials, such as MYLAR® a commercially available polymer, MYLAR® containing titanium, a layer of an organic or inorganic material having a semiconductive surface layer, such as indium tin oxide, or aluminum arranged thereon, or a conductive material inclusive of aluminum, chromium, nickel, brass, or the like. The substrate may be flexible, seamless, or rigid, and may have a number of different configurations, such as for example, a plate, a cylindrical drum, a scroll, an endless flexible belt, and the like. In embodiments, the substrate is in the form of a seamless flexible belt. In some situations, it may be desirable to coat on the back of the substrate, particularly when the substrate is a flexible organic polymeric material, an anticurl layer, such as for example polycarbonate materials commercially available as MAKROLON®, a polycarbonate resin having a weight average molecular weight of from about 50,000 to about 100,000, commercially available from Farbenfabriken Bayer A.G., or similar resin.

The thickness of the photoconductor substrate layer depends on many factors, including economical considerations, electrical characteristics, number of layers, components in each of the layers, and the like, thus this layer may be of substantial thickness, for example over about 3,000 microns, and more specifically the thickness of this layer can be from about 1,000 to about 3,000 microns, from about 100 to about 1,000 microns or from about 300 to about 700 microns, or of a minimum thickness. In embodiments, the thickness of this layer is from about 75 microns to about 300 microns, or from about 100 to about 150 microns.

A charge blocking layer or hole blocking layer may optionally be applied to the electrically conductive surface prior to the application of a photogenerating layer. When desired, an adhesive layer may be included between the charge blocking layer, the hole blocking layer or interfacial layer and the photogenerating layer. Usually, the photogenerating layer is applied onto the blocking layer and a charge transport layer or plurality of charge transport layers are formed on the photogenerating layer. This structure may have the photogenerating layer on top of or below the charge transport layer.

The hole blocking layer can be, for example, comprised of from about 20 weight percent to about 80 weight percent, and more specifically, from about 55 weight percent to about 65 weight percent of a suitable component like a metal oxide, such as $TiO_2$, from about 20 weight percent to about 70 weight percent, and more specifically, from about 25 weight percent to about 50 weight percent of a phenolic resin; from about 2 weight percent to about 20 weight percent and, more specifically, from about 5 weight percent to about 15 weight percent of a phenolic compound containing at least two phenolic groups, such as bisphenol S, and from about 2 weight percent to about 15 weight percent, and more specifically, from about 4 weight percent to about 10 weight percent of a plywood suppression dopant, such as $SiO_2$. The hole blocking layer coating dispersion can, for example, be prepared as follows. The metal oxide/phenolic resin dispersion is first prepared by ball milling or dynomilling until the median particle size of the metal oxide in the dispersion is less than about 10 nanometers, for example from about 5 to about 9. To the above dispersion are added a phenolic compound and dopant followed by mixing. The hole blocking layer coating dispersion can be applied by dip coating or web coating, and the layer can be thermally cured after coating. The hole blocking layer resulting is, for example, of a thickness of from about 0.01 micron to about 30 microns, and more specifically, from about 0.1 micron to about 8 microns. Examples of phenolic resins include formaldehyde polymers with phenol, p-tert-butylphenol, cresol, such as VARCUM™ 29159 and 29101 (available from OxyChem Company), and DURITE™ 97 (available from Borden Chemical); formaldehyde polymers with ammonia, cresol and phenol, such as VARCUM™ 29112 (available from OxyChem Company); formaldehyde polymers with 4,4'-(1-methylethylidene)bisphenol, such as VARCUM™ 29108 and 29116 (available from OxyChem Company); formaldehyde polymers with cresol and phenol, such as VARCUM™ 29457 (available from OxyChem Company), DURITE™ SD-423A, SD-422A (available from Borden Chemical); or formaldehyde polymers with phenol and p-tert-butylphenol, such as DURITE™ ESD 556C (available from Border Chemical).

The optional hole blocking layer may be applied to the substrate. Any suitable and conventional blocking layer capable of forming an electronic barrier to holes between the adjacent photoconductive layer (or electrophotographic imaging layer) and the underlying conductive surface of substrate may be selected.

The optional hole blocking or undercoat layers for the imaging members of the present disclosure can contain a number of components including known hole blocking components, such as amino silanes, doped metal oxides, TiSi, a metal oxide like titanium, chromium, zinc, tin and the like; a mixture of phenolic compounds and a phenolic resin or a mixture of two phenolic resins, and optionally a dopant such as $SiO_2$. The phenolic compounds usually contain at least two phenol groups, such as bisphenol A (4,4'-isopropylidenediphenol), E (4,4'-ethylidenebisphenol), F (bis(4-hydroxyphenyl)methane), M (4,4'-(1,3-phenylenediisopropylidene) bisphenol), P (4,4'-(1,4-phenylene diisopropylidene) bisphenol), S (4,4'-sulfonyldiphenol), and Z (4,4'-cyclohexylidenebisphenol); hexafluorobisphenol A (4,4'-(hexafluoro isopropylidene) diphenol), resorcinol, hydroxyquinone, catechin, and the like.

In embodiments, a suitable known adhesive layer can be included in the photoconductor. Typical adhesive layer materials include, for example, polyesters, polyurethanes, and the like. The adhesive layer thickness can vary and in embodiments is, for example, from about 0.05 micrometer (500 Angstroms) to about 0.3 micrometer (3,000 Angstroms). The adhesive layer can be deposited on the hole blocking layer by spraying, dip coating, roll coating, wire wound rod coating, gravure coating, Bird applicator coating, and the like. Drying of the deposited coating may be effected by, for example, oven drying, infrared radiation drying, air drying and the like.

As optional adhesive layers usually in contact with or situated between the hole blocking layer and the photogenerating layer, there can be selected various known substances inclusive of copolyesters, polyamides, poly(vinyl butyral), poly (vinyl alcohol), polyurethane and polyacrylonitrile. This layer is, for example, of a thickness of from about 0.001 micron to about 1 micron, or from about 0.1 to about 0.5 micron. Optionally, this layer may contain effective suitable amounts, for example from about 1 to about 10 weight percent, of conductive and nonconductive particles, such as zinc oxide, titanium dioxide, silicon nitride, carbon black, and the like, to provide, for example, in embodiments of the present disclosure further desirable electrical and optical properties.

The photogenerating layer in embodiments is comprised of, for example, about 60 weight percent of Type V hydroxygallium phthalocyanine or chlorogallium phthalocyanine, and about 40 weight percent of a resin binder like poly (vinyl chloride-co-vinyl acetate) copolymer, such as VMCH (available from Dow Chemical). Generally, the photogenerating layer can contain known photogenerating pigments, such as metal phthalocyanines, metal free phthalocyanines, alkylhydroxyl gallium phthalocyanines, hydroxygallium phthalocyanines, chlorogallium phthalocyanines, perylenes, especially bis(benzimidazo)perylene, titanyl phthalocyanines, and the like, and more specifically, vanadyl phthalocyanines, Type V hydroxygallium phthalocyanines, and inorganic components such as selenium, selenium alloys, and trigonal selenium. The photogenerating pigment can be dispersed in a resin binder similar to the resin binders selected for the charge transport layer, or alternatively no resin binder need be present. Generally, the thickness of the photogenerating layer depends on a number of factors, including the thicknesses of the other layers and the amount of photogenerating material contained in the photogenerating layer. Accordingly, this layer can be of a thickness of, for example, from about 0.05 micron to about 10 microns, and more specifically, from about 0.25 micron to about 2 microns when, for example, the photogenerating compositions are present in an amount of from about 30 to about 75 percent by volume. The maximum thickness of this layer in embodiments is dependent primarily upon factors, such as photosensitivity, electrical properties and mechanical considerations. The photogenerating layer binder resin is present in various suitable amounts, for example from about 1 to about 50, and more specifically, from about 1 to about 10 weight percent, and which resin may be selected from a number of known polymers, such as poly (vinyl butyral), poly(vinyl carbazole), polyesters, polycarbonates, poly(vinyl chloride), polyacrylates and methacrylates, copolymers of vinyl chloride and vinyl acetate, phenolic resins, polyurethanes, poly(vinyl alcohol), polyacrylonitrile, polystyrene, and the like. It is desirable to select a coating solvent that does not substantially disturb or adversely affect the other previously coated layers of the device. Examples of coating solvents for the photogenerating layer are ketones, alcohols, aromatic hydrocarbons, halogenated aliphatic hydrocarbons, ethers, amines, amides, esters, and the like. Specific solvent examples are cyclohexanone, acetone, methyl ethyl ketone, methanol, ethanol, butanol, amyl alcohol, toluene, xylene, chlorobenzene, carbon tetrachloride, chloroform, methylene chloride, trichloroethylene, tetrahydrofuran, dioxane, diethyl ether, dimethyl formamide, dimethyl acetamide, butyl acetate, ethyl acetate, methoxyethyl acetate, and the like.

The photogenerating layer may comprise amorphous films of selenium and alloys of selenium and arsenic, tellurium, germanium and the like, hydrogenated amorphous silicon and compounds of silicon and germanium, carbon, oxygen, nitrogen and the like fabricated by vacuum evaporation or deposition. The photogenerating layers may also comprise inorganic pigments of crystalline selenium and its alloys; Group II to VI compounds; and organic pigments such as quinacridones, polycyclic pigments such as dibromo anthanthrone pigments, perylene and perinone diamines, polynuclear aromatic quiniones, azo pigments including bis-, tris- and tetrakis-azos; and the like dispersed in a film forming polymeric binder and fabricated by solvent coating techniques; and a number of phthalocyanines, like a titanyl phthalocyanine, titanyl phthalocyanine Type V; oxyvanadium phthalocyanine, chloroaluminum phthalocyanine, copper phthalocyanine, oxytitanium phthalocyanine, chlorogallium phthalocyanine, hydroxygallium phthalocyanine magnesium phthalocyanine and metal free phthalocyanine and the like with infrared sensitivity photoreceptors exposed to low-cost semiconductor laser diode light exposure devices.

In embodiments, examples of polymeric binder materials that can be selected as the matrix for the photogenerating layer are illustrated in U.S. Pat. No. 3,121,006, the disclosure of which is totally incorporated herein by reference. Examples of binders are thermoplastic and thermosetting resins, such as polycarbonates, polyesters, polyamides, polyurethanes, polystyrenes, polyarylethers, polyaryl sulfones, polybutadienes, polysulfones, polyethersulfones, polyethylenes, polypropylenes, polyimides, polymethylpentenes, poly (phenylene sulfides), poly(vinyl acetate), polysiloxanes, polyacrylates, polyvinyl acetals, polyamides, polyimides, amino resins, phenylene oxide resins, terephthalic acid resins, phenoxy resins, epoxy resins, phenolic resins, polystyrene and acrylonitrile copolymers, poly(vinyl chloride), vinyl chloride and vinyl acetate copolymers, acrylate copolymers, alkyd resins, cellulosic film formers, poly(amideimide), styrenebutadiene copolymers, vinylidene chloride-vinyl chloride copolymers, vinyl acetate-vinylidene chloride copolymers, styrene-alkyd resins, poly(vinyl carbazole), and the like. These polymers may be block, random or alternating copolymers.

The coating of the photogenerating layer in embodiments of the present disclosure can be accomplished with spray, dip or wire-bar methods such that the final dr, thickness of the photogenerating layer is as illustrated herein, and can be, for example, from about 0.01 to about 30 microns after being dried at, for example, about 40° to about 150° C. for about 15 to about 90 minutes. More specifically, photogenerating layer of a thickness, for example, of from about 0.1 to about 30, or from about 0.5 to about 2 microns can be applied to or deposited on the substrate, on other surfaces in between the substrate and the charge transport layer, and the like. The photogenerating composition or pigment is present in the resinous binder composition in various amounts. From about 5 percent by volume to about 90 percent by volume of the photogenerating pigment is dispersed in about 10 percent by volume to about 95 percent by volume of the resinous binder, or from about 20 percent by volume to about 30 percent by volume of the photogenerating pigment is dispersed in about 70 percent by volume to about 80 percent by volume of the resinous binder composition. In one embodiment, about 10 percent by volume of the photogenerating pigment is dispersed in about 90 percent by volume of the resinous binder composition.

Various suitable and conventional known processes may be used to mix, and thereafter apply the photogenerating layer coating mixture, like spraying, dip coating, roll coating, wire wound rod coating, vacuum sublimation, and the like. For some applications, the photogenerating layer may be fabricated in a dot or line pattern. Removal of the solvent of a solvent-coated layer may be effected by any known conventional techniques such as oven drying, infrared radiation drying, air-drying and the like.

The charge transport layer, such layer being generally of a thickness of from about 5 microns to about 90 microns, and more specifically, of a thickness of from about 10 microns to about 40 microns, may include a number of hole transport compounds, such as substituted biphenyl diamines and known hole transport molecules, as illustrated herein, and additional components, including additives, such as antioxidants, a number of polymer binders and the like.

The charge transport layer may comprise hole transporting small molecules dissolved or molecularly dispersed in a film forming electrically inert polymer such as a polycarbonate. In embodiments, "dissolved" refers, for example, to forming a solution in which the small molecule is dissolved in the polymer to form a homogeneous phase; and "molecularly dispersed in embodiments" refers, for example, to hole transporting molecules dispersed in the polymer, the small molecules being dispersed in the polymer on a molecular scale. Various hole transporting or electrically active small molecules may be selected for the charge transport layer or layers. In embodiments, hole transport refers, for example, to hole transporting molecules as a monomer that allows the free charge generated in the photogenerating layer to be transported across the transport layer.

In embodiments, the hole transport molecule may be a tertiary arylamine charge transport molecule represented by the following general formula

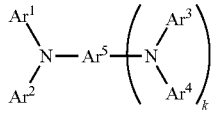

wherein $Ar^1$, $Ar^3$, and $Ar^4$ each independently represents a substituted or unsubstituted aryl group having from about 6 to about 30 carbons, $Ar^5$ independently represents a substituted or unsubstituted aromatic group from about 6 to about 30 carbons, and k represents 0 or 1. Illustrative examples of aryl group include a phenyl, a biphenyl, a terphenyl, a naphthyl and the like, which may further contain a constituent selected from the group consisting of an alkyl having from 1 to about 12 carbons, a cycloalkyl group having from about 3 to about 12 carbons, an alkoxy having from 1 to about 12 carbons, an organosiloxane group, a halogen atom, and the like. In embodiments, the hole transport molecule may exhibit an oxidation potential of from about 0.6 V to about 1.5 V, such as from about 0.75 V to about 1.0 V, as measured vs. Ag/AgCl in 0.1 M tetra-n-butylammonium perchlorate in dichloromethane.

An additional hole transport molecule can be, for example, a substituted biphenyl diamine represented by the following general formula:

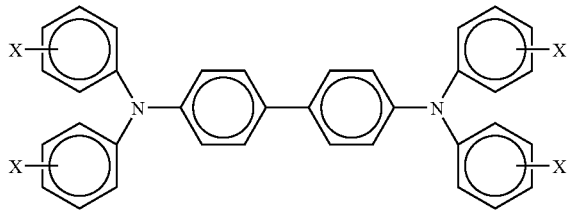

such as N,N,N'N'-tetra(4-methylphenyl)-(1,1'-biphenyl)-4,4'-diamine, wherein each X is independently selected from the group consisting of —H, —OH, alkyl (—$C_nH_{2n+1}$) where n is from 1 to about 10 such as from 1 to about 5 or from 1 to about 6, aralkyl, and aryl groups, the aralkyl and aryl groups having, for example, from about 5 to about 30, such as about 6 to about 20, carbon atoms. Suitable examples of aralkyl groups include, for example, —$C_nH_{2n}$-phenyl groups where n is from 1 to about 5 or from 1 to about 10. Suitable examples of aryl groups include, for example, phenyl, naphthyl, biphenyl, and the like. Alkyl contains for example, from 1 to about 25 carbon atoms, from 1 to about 16 carbon atoms, from 1 to about 10 carbon atoms, or from 1 to about 6 carbon atoms, such as methyl, ethyl, propyl, butyl, pentyl, heptyl, hexyl, dodecyl, and the like.

Examples of hole transporting molecules, include, for example, pyrazolines such as 1-phenyl-3-(4'-diethylamino styryl)-5-(4"-diethylamino phenyl)pyrazoline; aryl amines such as N,N'-diphenyl-N,N'-bis(3-methylphenyl)-(1,1'-biphenyl)-4,4'-diamine, N,N'-bis(4-butylphenyl)-N,N'-di-p-tolyl-[p-terphenyl]-4,4"-diamine, N,N'-bis(4-butylphenyl)-N,N'-di-m-tolyl-[p-terphenyl]-4,4"-diamine, N,N'-bis(4-butylphenyl)-N,N'-di-o-tolyl-[p-terphenyl]-4,4"-diamine, N,N'-bis(4-butylphenyl)-N,N'-bis-(4-isopropylphenyl)-[p-terphenyl]-4,4"-diamine, N,N'-bis(4-butylphenyl)-N,N'-bis-(2-ethyl-6-methylphenyl)-[p-terphenyl]-4,4"-diamine, N,N'-bis(4-butylphenyl)-N,N'-bis-(2,5-dimethylphenyl)-[p-terphenyl]-4,4"-diamine, N,N'-diphenyl-N,N'-bis(3-chlorophenyl)-[p-terphenyl]-4,4"-diamine; hydrazones such as N-phenyl-N-methyl-3-(9-ethyl)carbazyl hydrazone and 4-diethyl amino benzaldehyde-1,2-diphenyl hydrazone; and oxadiazoles such as 2,5-bis(4-N,N'-diethylaminophenyl)-1,2,4-oxadiazole, stilbenes, and the like. However, in embodiments to minimize or avoid cycle-up in equipment, such as printers, with high throughput, the charge transport layer should be substantially free (less than about two percent) of di or triamino-triphenyl methane. A small molecule charge transporting compound that permits injection of holes into the photogenerating layer with high efficiency and transports them across the charge transport layer with short transit times includes N,N'-diphenyl-N,N'-bis(3-methylphenyl)-(1,1'-biphenyl)-4,4'-diamine, N,N'-bis(4-butylphenyl)-N,N'-di-p-tolyl-[p-terphenyl]-4,4"-diamine, N,N'-bis(4-butylphenyl)-N,N'-di-m-tolyl-[p-terphenyl]-4,4"-diamine, N,N'-bis(4-butylphenyl)-N,N'-di-o-tolyl-[p-terphenyl]-4,4"-diamine, N,N'-bis(4-butylphenyl)-N,N'-bis-(4-isopropylphenyl)-[p-terphenyl]-4,4"-diamine, N,N'-bis(4-butylphenyl)-N,N'-bis-(2-ethyl-6-methylphenyl)-[p-terphenyl]-4,4"-diamine, N,N'-bis(4-butylphenyl)-N,N'-bis-(2,5-dimethylphenyl)-[p-terphenyl]-4,4"-diamine, and N,N'-diphenyl-N,N'-bis(3-chlorophenyl)-[p-terphenyl]-4,4"-diamine, tetra[p-tolyl] biphenyldiamine also referred to as N,N,N'N'-tetra(4-methylphenyl)-(1,1'-biphenyl)-4,4'-diamine; N,N,N'N'-tetra(4-ethylphenyl)-(1,1'-biphenyl)-4,4'-diamine; N,N,N'N'-tetra(4-propylphenyl)-(1,1'-biphenyl)-4,4'-diamine; N,N,N'N'-tetra(4-butylphenyl)-(1,1'-biphenyl)-4,4'-diamine and the like, or mixtures thereof. If desired, the hole transport material in the charge transport layer may comprise a polymeric hole transport material or a combination of a small molecule hole transport material and a polymeric hole transport material.

Yet further exemplary specific substituted biphenyl diamines having the above formulae may include N,N'-diphenyl-N,N'-bis(alkylphenyl)-1,1-biphenyl-4,4'-di-nine wherein alkyl is selected from the group consisting of methyl, ethyl, propyl, butyl, hexyl, and the like; N,N'-diphenyl-N,N'-bis(halophenyl)-1,1'-biphenyl-4,4'-diamine wherein the halo substituent is a chloro substituent; N,N'-bis(4-butylphenyl)-N,N'-dip-tolyl-[p-terphenyl]-4,4"-diamine, N,N'-bis(4-butylphenyl)-N,N'-di-m-tolyl-[p-terphenyl]-4,4"-diamine, N,N'-bis(4-butylphenyl)-N,N'-di-o-tolyl-[p-terphenyl]-4,4"-diamine, N,N'-bis(4-butylphenyl)-N,N'-bis-(4-isopropylphenyl)-[p-terphenyl]-4,4"-diamine, N,N'-bis(4-butylphenyl)-N,N'-bis-(2-ethyl-6-methylphenyl)-[p-terphenyl]-4,4"-diamine, N,N'-bis(4-butylphenyl)-N,N'-bis-(2,5-dimethylphenyl)-[p-terphenyl]-4,4'-diamine, N,N'-diphenyl-N,N'-bis(3-chlorophenyl)-[p-terphenyl]-4,4"-diamine, and the like. Other known charge transport layer molecules can be selected, reference for example, U.S. Pat. Nos. 4,921,773 and 4,464,450, the disclosures of which are totally incorporated herein by reference.

The substituted biphenyl diamine may be of high quality, such as N,N,N'N'-tetra(4-methylphenyl)-(1,1'-biphenyl)-4,4'-diamine, such that, when incorporated into a photoreceptor, the photoreceptor will exhibit an improved rate of discharge of its surface potential as well as improved cycling stability. As used herein, the term "cycling stability" refers to lack of change in electrical characteristics during electrophotographic cycling. Improving discharge rate is advantageous because high speed printing applications require a shorter expose to development time within which the photoreceptor must discharge its surface potential. Therefore, photoreceptors exhibiting an improved discharge rate are important in high speed printing applications and the like, and may reduce the overall costs associated with large-scale or commercial printing operations. In embodiments, the photoreceptor may discharge from about 85% to about 100% of its surface potential in from about 0 to about 40 milliseconds upon being subjected to xerographic charging and exposure to radiant energy of from about 1 erg/$cm^2$ to about 5 ergs/$cm^2$ such as from about 85% to about 100% of its surface potential in from about 0 to about 40 milliseconds of being subjected to xerographic charging and exposure to radiant energy of about 1 erg/$cm^2$ to about 4 ergs/$cm^2$. As used herein, "high quality" referring to the substituted biphenyl diamine thus refers to a substituted biphenyl diamine that, when incorporated into a photoreceptor, the photoreceptor will discharge from about 90% to about 100% of its surface potential in from 0 to about 40 milliseconds upon being subjected to xerographic charging and exposure to radiant energy of about 1 ergs/$cm^2$ to about 3 ergs/$cm^2$. In embodiments, a photoreceptor comprising the high quality substituted biphenyl diamine may have a post erase voltage of from about 0 to about 10 volts, from an initial charging voltage of from about 400 to about 1000 volts, when erase energy is about 200 ergs/cm$^2$. The substituted biphenyl diamine may also exhibit stable xerographic cycling over 10,000 cycles.

In embodiments, the charge transport layer is comprised of at least one hole transport component of the above-mentioned formulas/structures. The concentration of the hole transport component may be low to, for example, achieve increased mechanical strength and LCM resistance in the photoconductor. In embodiments the concentration of the hole transport component in the charge transport layer may be from about 10 weight percent to about 65 weight percent and more specifically from about 35 to about 60 weight percent, or from about 45 to about 55 weight percent.

In embodiments, the charge transport layer is comprised of at least one antioxidant with the tertiary aryl amine hole transport material, that can be chosen, for example, from among and antioxidants that are sterically hindered bis-phenols, sterically hindered dihydroquinones, or sterically hindered amines.

In embodiments, sterically hindered bis-phenols can be of the following general stricture A-1:

A-1

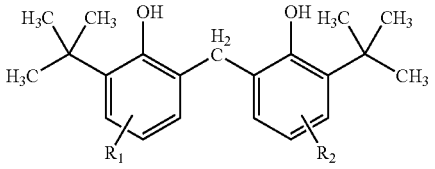

wherein R1 and R2 are each a hydrogen atom, a halogen atom, or a hydrocarbyl group having from 1 to about 10 carbon atoms, or the following general structure A-2:

A-2

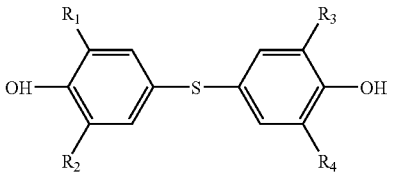

wherein R1, R2, R3, and R4 are each a hydrocarbyl group having from 1 to about 10 carbon atoms.

Exemplary specific sterically hindered bis-phenols may be, for example, 2,2'-methylenebis(4-ethyl-6-tert-butylphenol) and 2,2'-methylenebis(4-methyl-6-tert-butylphenol).

In embodiments, sterically hindered dihydroquinones can be of the following general structure A-3:

A-3

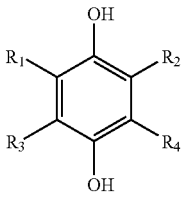

wherein R1, R2, R3, and R4 are each a hydrocarbyl group having from 1 to about 10 carbon atoms.

Exemplary specific sterically hindered dihydroquinones may be, for example, 2,5-di(tert-amyl)hydroquinone, 4,4'-thiobis(6-tert-butyl-o-cresol and 2,5-di(tert-amyl)hydroquinone.

In embodiments, sterically hindered amines can be of the following general structure A-4:

A-4

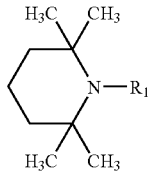

wherein R1 is a hydrocarbyl group having from 1 to about 10 carbon atoms

Exemplary specific sterically hindered amines may be, for example, 2 uch as 4,4'-[4-(diethylamino)phenyl)methylene] bis(N,N diethyl-3-methylaniline and bis(1,2,2,6,6-pentamethyl-4-piperidinyl)(3,5-di-tert-butyl-4-hydroxybenzyl)butylpropanedioate.

In embodiments, the antioxidant may comprise both a sterically hindered amine and phenol and have the common structure A-6:

A-6

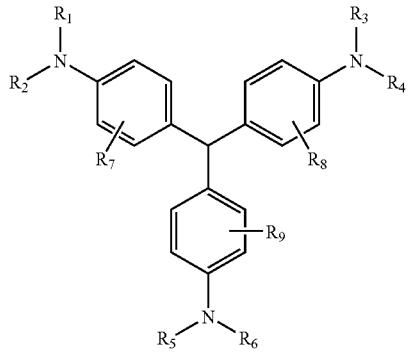

wherein R1, R2, R3, and R4 are each a hydrocarbyl group having from 1 to about 10 carbon atoms.

In embodiments, the concentration of the antioxidant(s) may be, for example, from 0.01 percent to about 25 percent of the charge transport layer by weight, such as from about 0.1 percent to about 20 percent, or from about 0.5 percent to about 10 percent, or from about 0.5 percent to about 8 percent by weight.

Further examples of antioxidants optionally incorporated into the charge transport layer or at least one charge transport layer to, for example, assist in permitting improved lateral charge migration (LCM) resistance include hindered phenolic antioxidants, such as tetrakis methylene(3,5-di-tert-butyl-4-hydroxy hydrocinnamate) methane (IRGANOX 1010™, available from Ciba Specialty Chemical), butylated hydroxytoluene (BHT), and other hindered phenolic antioxidants including SUMILIZER BHT-R™, MDP-S™, BBM-S™, WX-R™, NW™, BP-76™, BP-101™, GA-80™, GM™ and GS™ (available from Sumitomo Chemical Co., Ltd.), IRGANOX 1035™, 1076™, 1098™, 1135™, 1141™, 1222™, 1330™, 1425WL™, 1520L™, 245™, 259™, 3114™, 3790™, 5057™ and 565™ (available from Ciba Specialties Chemicals), and ADEKA STAB AO-20™, AO-30™, AO-40™, AO-50™, AO-60™, AO-70™, AO-80™ and AO-330™ (available from Asahi Denka Co., Ltd.); hindered amine antioxidants such as SANOL LS-2626™, LS-765™, LS-770™ and LS-744™ (available from SNKYO CO., Ltd.), TINUVIN 144™ and 622LD™ (available from Ciba Specialties Chemicals), MARK LA57™, LA67™, LA62™, LA68™ and LA63™ (available from Asahi Denka Co., Ltd.), and SUMILIZER TPS™ (available from Sumitomo Chemical Co., Ltd.), thioether antioxidants such as SUMILIZER TP-D™(available from Sumitomo Chemical Co., Ltd); phosphite antioxidants such as MARK 2112™, PEP-8™, PEP-24G™, PEP-36™, 329K™ and HP-10™ (available from Asahi Denka Co., Ltd.); other molecules such as bis(4-diethylamino-2-methylphenyl)phenylmethane (BDETPM), bis-[2-methyl-4-(N-2-hydroxyethyl-N-ethylaminophenyl)]-phenylmethane (DHTPM), and the like. The weight percent of the antioxidant in the charge transport layer is from about 0 to about 20, from about 1 to about 10, or from about 3 to about 8 weight percent.

Examples of the binder materials selected for the charge transport layer include components, such as those described in U.S. Pat. No. 3,121,006, the entire disclosure of which is totally incorporated herein by reference. Specific examples of polymer binder materials include polycarbonates, polyarylates, acrylate polymers, vinyl polymers, cellulose polymers, polyesters, polysiloxanes, polyamides, polyurethanes, poly (cyclo olefins), epoxies, and random or alternating copolymers thereof, and more specifically, polycarbonates such as poly(4,4'-isopropylidene-diphenylene)carbonate (also referred to as bisphenol-A-polycarbonate), poly(4,4'-cyclohexylidinediphenylene)carbonate (also referred to as bisphenol-Z-polycarbonate), poly(4,4'-isopropylidene-3,3'-dimethyl-diphenyl)carbonate (also referred to as bisphenol-C-polycarbonate), and the like. In embodiments, electrically inactive binders are comprised of polycarbonate resins with a molecular weight of from about 20,000 to about 100,000, or with a molecular weight $M_w$ of from about 50,000 to about 100,000 for example. Generally, the transport layer contains from about 10 to about 75 percent by weight of the hole transport material, and more specifically, from about 35 percent to about 50 percent of this material.

The thickness of the charge transport layer selected depends upon the abrasiveness of the charging (bias charging roll), cleaning (blade or web), development (brush), transfer (bias transfer roll), and the like in the system employed, and can be from about 5 to about 100 micrometers. The charge transport layer should be an insulator to the extent that an electrostatic charge placed on the hole transport layer is not conducted in the absence of illumination at a rate sufficient to prevent formation and retention of an electrostatic latent image thereon. In general, the ratio of the thickness of the charge transport layer to the photogenerating layer can be from about 2:1 to 200:1, and in some instances 400:1. The charge transport layer is substantially nonabsorbing to visible light or radiation in the region of intended use, but is electrically "active" in that it allows the injection of photogenerated holes from the photoconductive layer, or photogenerating layer, and allows these holes to be transported through itself to selectively discharge a surface charge on the surface of the active layer.

Various suitable and conventional methods may be used to mix, and thereafter apply the charge transport layer coating mixture to the photogenerating layer. Typical application techniques include spraying, dip coating, roll coating, wire wound rod coating, and the like. Drying of the deposited coating may be effected by any suitable conventional technique, such as oven drying, infrared radiation drying, air drying, and the like. The dried overcoating layer of this disclosure should transport holes during imaging and should not have too high a free carrier concentration. Free carrier concentration in the overcoat increases the dark decay.

The following Examples are being submitted to illustrate embodiments of the present disclosure. These Examples are intended to be illustrative only, and are not intended to limit the scope of the present disclosure. Also, parts and percentages are by weight unless otherwise indicated. Comparative Examples and data are also provided.

EXAMPLES

Charge transport layers of photoreceptors can be prepared by any conventional means or any other method obvious to those skilled in the art which would produce the desired overcoat layer.

Example Compounds 1 and 2

Example compounds 1 and 2 are sterically hindered bisphenols of the formula 2,2'-methylenebis(4-ethyl-6-tert-butylphenol) and 2,2'-methylenebis(4-methyl-6-tert-butylphenol).

Example Compounds 3 and 4

Example compounds 3 and 4 are sterically hindered dihydroquinones of the formulae 2,5-di(tert-amyl)hydroquinone, and 4,4'-thiobis(6-tert-butyl-o-cresol), respectively.

Example Compounds 5 and 6

Example compounds 5 and 6 are sterically hindered amines of the formulae 4,4'-[4-(diethylamino)phenyl]methylene]bis(N,N diethyl-3-methylaniline; and bis(1,2,2,6,6-pentamethyl-4-piperidinyl)(3,5-di-tert-butyl-4-hydroxybenzyl)butylpropanedioate, respectively.

Example Compounds 7-9

Example compounds 7-9 are compounds know in the art under the tradenames Cyanox 1790. Tinuvin 622, and T1096, respectively.

Comparative Example Compounds 1-6

Six comparative antioxidants were produced according to the methods described above and are listed in the following table.

| | |
|---|---|
| Comparative Example 1 | Irgafos 126 |
| Comparative Example 2 | Irgafos P-EPQ |
| Comparative Example 3 | Lowlite 77 |
| Comparative Example 4 | Irgafos 12 |
| Comparative Example 5 | Irgafos 38 |
| Comparative Example 6 | Chimassorb 944 |

Example 1

An imaging or photoconducting member incorporating Compound 1 was prepared in accordance with the following procedure. A metallized mylar substrate was provided and a HOGaPc/poly(bisphenol-Z carbonate) photogenerating layer was machine coated over the substrate. The photogenerating layer was overcoated with a charge transport layer prepared by introducing into an amber glass bottle 6.8 weight percent of Example Compound 1, and about 43.2 weight percent of N,N,N'N'-tetra(4-methylphenyl)-(1,1'-biphenyl)-4,4'-diamine and 43.2 weight percent of MAKROLON 5705®, a known polycarbonate resin having a molecular weight average of from about 50,000 to about 100,000, commercially available from Farbenfabriken Bayer A.G. The resulting mixture was then dissolved in methylene chloride to form a solution containing 15 percent by weight solids. This solution was applied on the photogenerating layer to form a layer coating that upon drying (120° C.) for 1 minute) had a thickness of 30 microns. During this coating process, the humidity was equal to or less than about 15 percent.

Photoconductors were also prepared by repeating the process of Example 1 except that the charge transport layer in each instance was prepared by introducing into an amber glass bottle 6.8 weight percent of each of Example Compounds 2-9, and about 43.2 weight percent of N,N,N'N'-tetra (4-methylphenyl)-(1,1'-biphenyl)-4,4'-diamine and 43.2 weight percent MAKROLON 5705.

Control:

A control photoconductor was prepared by repeating the process of Example 1 except that the charge transport layer is prepared by introducing into an amber glass bottle 50 weight percent of N,N,N'N'-tetra(4-methylphenyl)-(1,1'-biphenyl)-4,4'-diamine, without an antioxidant, and about 50 weight percent MAKROLON 5705.

Comparative Examples 1-6

Comparative photoconductors were prepared by repeating the process of Example 1 except that the charge transport layer is prepared by introducing into an amber glass bottle the charge transport material, about 43.2 weight percent MAKROLON 5705, and each of the respective Comparative Example antioxidants 1-6.

Electrical Property Testing:

The xerographic electrical properties of the above prepared photoconductors were determined by electrostatically charging their surfaces with a corona discharging device, in the dark, until the surface potential attained an initial value of $V_o$ of about 800 volts as measured by a capacitively coupled probe attached to an electrometer. 500 ms after the $V_o$ measurement a second measurement is taken ($V_{ddp}$). The difference between $V_o$ and $V_{ddp}$ is called the dark decay ($V_o - V_{ddp}$). The charged members were then exposed to light (780 nm) from a filtered xenon lamp. A reduction in the surface potential to Vr residual potential due to photodischarge effect, was observed 1000 ms following exposure to a high intensity (200 ergs/cm$^2$) light (600-800 nm) from a filtered Xenon lamp. The results obtained for the photoconductive members fabricated in accordance with the above examples are illustrated in FIG. 1.

As can be seen in FIG. 1, Examples 1-9 show similar or improved dark decay and residual voltage characteristics than the control and than the comparative Examples. Each of the examples 1-9 are capable of incorporation into the charge transport layer without significant negative electrical impacts such as increased Dark Decay and increased Residual Voltage.

Lateral Charge Migration Testing (LCM):

LCM resistance was evaluated by a print testing scheme. The above prepared hand coated photoconductor devices were cut into 6"×1"strips. One end of the strip from the respective devices was cleaned using a solvent to expose the metallic conductive layer on the substrate. The conductivity of the exposed metallic conductive layer was then measured to ensure that the metal had not been removed during cleaning. The conductivity of the exposed metallic conductive layer was measured using a multimeter to measure the resistance across the exposed metal layer (around 1 KOhm). A fully operational 85 mm DC12 A Xerox Corporation standard Docu Color photoreceptor drum was prepared by exposing a strip of bare aluminum (0.5") around the circumference of the drum to provide the ground for the handcoated device when it is operated. The cleaning blade was removed from the drum housing to prevent it from removing the handcoated devices during operation. The hand coated imaging members were then mounted horizontally (lengthwise along drum) onto the prepared photoreceptor drum using conductive copper tape to adhere the exposed conductive end of the devices to the exposed aluminum strip on the drum to complete a conductive path to the ground. After mounting the devices, the device-to-drum conductivity was measured using a standard multimeter in a resistance mode. The resistance between the respective devices and the drum should be similar to the resistance of the conductive coating on the respective hand coated devices. All edges of the devices are then secured to the drum using scotch tape, and all exposed conductive surfaces were covered with scotch tape. The drum was then placed in a Docu-color 12 (DC12) machine and a template containing 1 bit, 2 bit, 3 bit, 4 bit, and 5 bit lines was printed. The machine settings (developer bias, laser power, grid bias.) were adjusted to obtain visible print that resolved the 5 individual lines above. If the 1 bit line is barely showing, then the settings are saved and the print becomes the reference, or the pre-exposure print. The drum was removed and placed in charge-discharge apparatus generates corona discharge during operation. The drum was charged and discharged (cycled) for 1000, 5000, and 10,000 cycles to induce deletion (LCM). After each cycle interval the drum was then removed from the apparatus and placed in the DC12 machine and the template was printed. Prints obtained at 0, 1000, 5000, and 10,000 cycles were then evaluated visually for any changes in print quality. The results obtained for the photoconductive members fabricated in accordance with the above examples are illustrated in FIG. 2.

Figure 2:
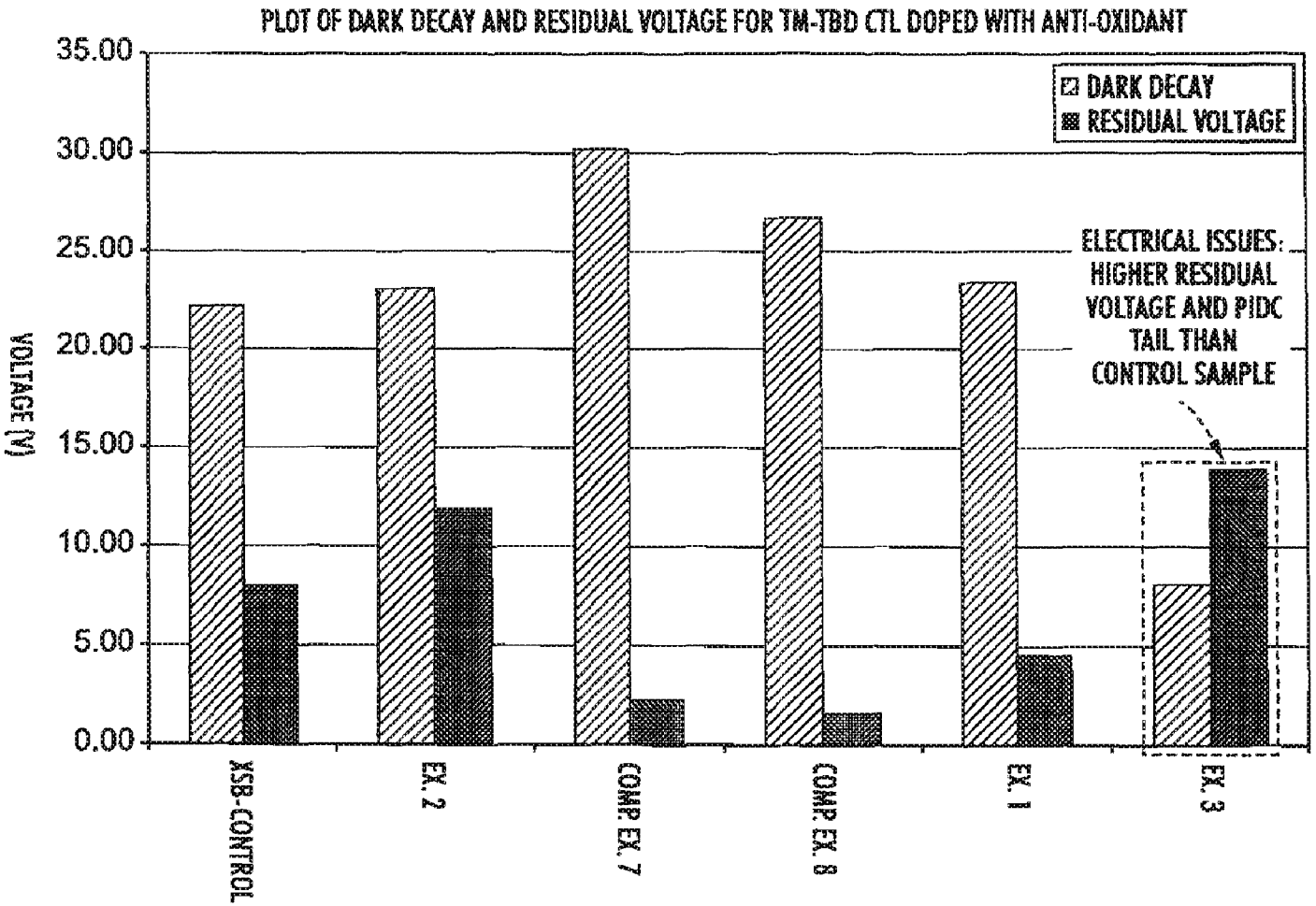
Figure 3:
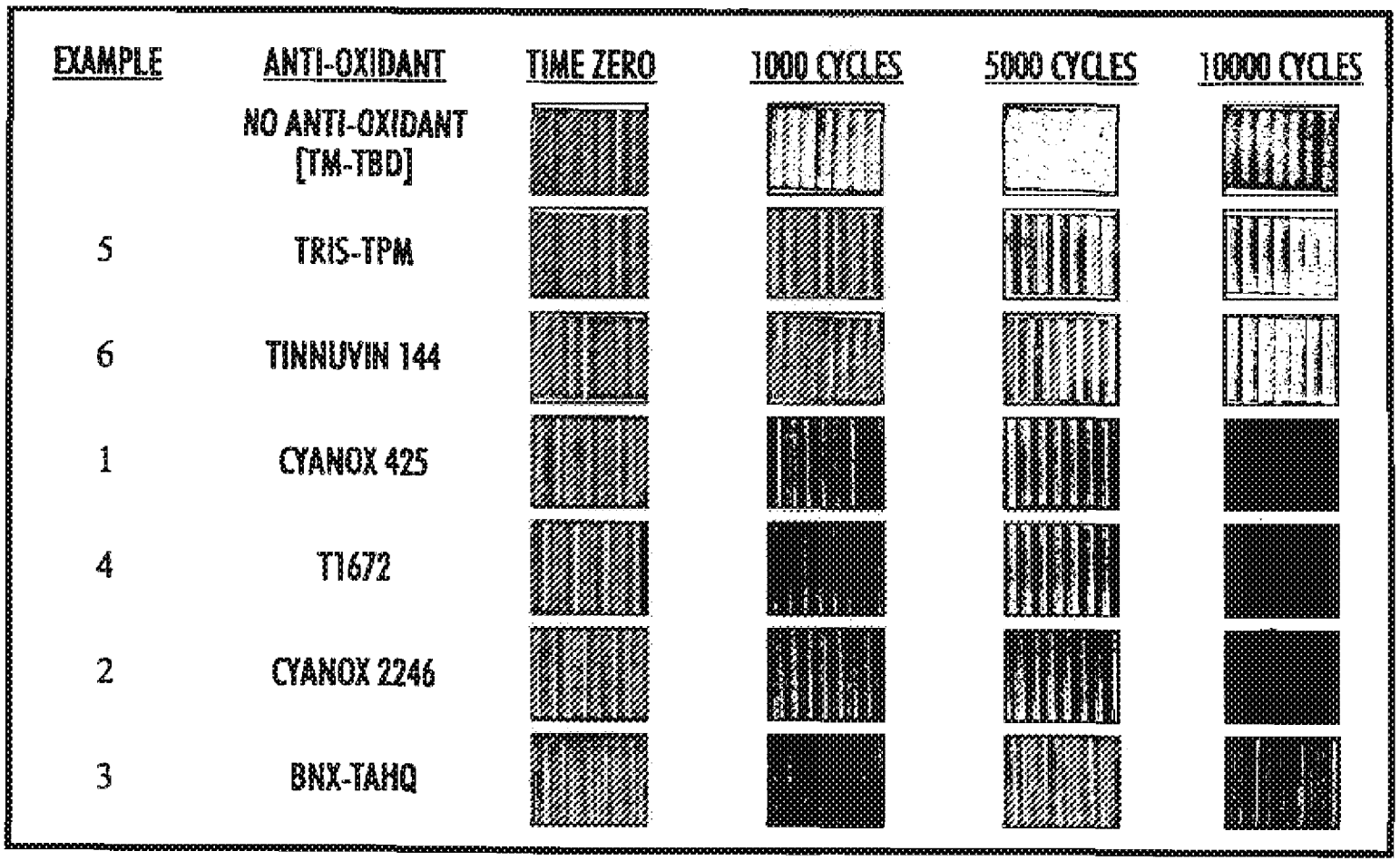
FIG. 3 is a comparison showing lateral charge migration for photoreceptors of the Examples and Comparative Examples of the disclosure.

As can be seen in FIG. 2, Examples 1-6 showed improved LCM characteristics (print quality) when compared to the control example (no anti-oxidant). Each of Examples 1-6 is one of a sterically hindered bis-phenol, sterically hindered dihydroquinone or sterically hindered amine. Thus, sterically hindered bis-phenols, sterically hindered dihydroquinones and sterically hindered amines are shown to exhibit improved LCM resistance and therefore increased image quality. BNX-TAHQ appears gives the best deletion resistance out of all the samples It will be appreciated that various of the above-disclosed and other features and functions, or alternatives thereof, may be desirably combined into many other different systems or applications. Also, various presently unforeseen or unanticipated alternatives, modifications, variations or improvements therein may be subsequently made by those skilled in the art, and are also intended to be encompassed by the following claims.

What is claimed is:

1. A photoreceptor comprising:

a substrate;

a charge generating layer;

a charge transport layer comprising a N,N,N'N'-tetra(4-methylphenyl)-(1,1'-biphenyl)-4,4'-diamine charge transport molecule and an antioxidant selected to match the oxidation potential of the charge transport molecule and selected from the group consisting of sterically hindered bis-phenols with a common structure of A-1

A-1

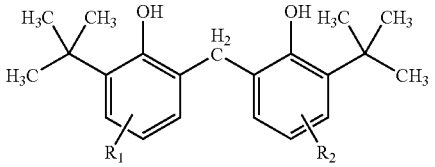

wherein R1 and R2 are each a hydrogen atom, a halogen atom, or a hydrocarbyl group having from 1 to about 10 carbon atoms, and sterically hindered dihydroquinones with a common structure of A-3

A-3

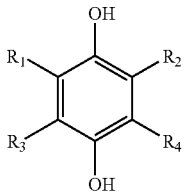

wherein R1, R2, R3, and R4 are each a hydrocarbyl group having from 1 to about 10 carbon atoms.

2. The photoreceptor of claim 1, wherein the antioxidant is selected from the group consisting of 2,2'-methylenebis(4-ethyl-6-tert-butylphenol), 2,2'-methylenebis(4-methyl-6-tert-butylphenol), and 2,5-di(tert-amyl)hydroquinone.

3. The photoreceptor of claim 1, wherein the antioxidant is present in the charge transport layer in an amount of from about 0.1% to about 20% by weight.

4. The photoreceptor of claim 1, wherein the antioxidant is present in the charge transport layer in an amount of from about 0.5% to about 10% by weight.

5. The photoreceptor of claim 1, wherein the antioxidant is present in the charge transport layer in an amount of from about 0.5% to about 8% by weight.

6. The photoreceptor of claim 1, wherein the antioxidant is present in the charge transport layer in an amount of from about 1% to about 8% by weight.

7. The photoreceptor of claim 1, wherein said charge transport layer comprises from about 25 to 65 weight % of N,N,N'N'-tetra(4-methylphenyl)-(1,1'-biphenyl)-4,4'-diamine, from about 30 to about 75% of a polymer binder of a polycarbonate or a polyester, and from about 0.5 to 10% of the anti-oxidant selected from the group consisting of 2,2'-methylenebis(4-ethyl-6-tert-butylphenol), 2,2'-methylenebis(4-methyl-6-tert-butylphenol), and 2,5-di(tert-amyl)hydroquinone.

8. The photoreceptor of claim 1, wherein said photoreceptor further comprises a protective layer in contact with said charge transport layer, where the protective layer is comprised of a cured coating composition comprising a tertiary arylamine having a hydroxyl group and a melamine-formaldehyde resin.

9. The photoreceptor of claim 1, wherein said charge generating layer comprises a photosensitive pigment selected from the group consisting of titanyl phthalocyanine, titanyl phthalocyanine Type V, chlorogallium phthalocyanine, hydroxygallium phthalocyanine, and metal free phthalocyanine.

10. An image forming apparatus comprising a photoreceptor of claim 1.

11. A process for forming a photoreceptor comprising:

providing a photoreceptor substrate;

applying a charge generating layer;

applying a charge transport layer comprising a N,N,N'N'-tetra(4-methylphenyl)-(1,1'-biphenyl)-4,4'-diamine tertiary arylamine charge transport molecule; and an antioxidant selected to match the oxidation potential of the tertiary arylamine charge transport molecule and selected from the group consisting of sterically hindered bis-phenols with a common structure of A-1

A-1

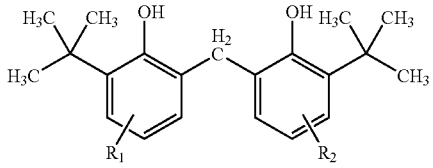

wherein R1 and R2 are each a hydrogen atom, a halogen atom, or a hydrocarbyl group having from 1 to about 10 carbon atoms, and sterically hindered dihydroquinones with a common structure of A-3

A-3

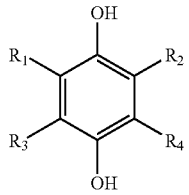

wherein R1, R2, R3, and R4 are each a hydrocarbyl group having from 1 to about 10 carbon atoms.

* * * * *